United States Patent [19]

Vitt

[11] 4,365,384

[45] Dec. 28, 1982

[54] CONCEALED MULTI PINTLE LATCH HINGE

[75] Inventor: Theodor Vitt, Cologne, Fed. Rep. of Germany

[73] Assignee: Prameta Prazisionsmetall -und Kunststofferzeugnisse G. Baumann & Company, Cologne, Fed. Rep. of Germany

[21] Appl. No.: 147,789

[22] Filed: May 8, 1980

[30] Foreign Application Priority Data

May 9, 1979 [DE] Fed. Rep. of Germany ..... 2918660

[51] Int. Cl.[3] ..... E05F 1/14

[52] U.S. Cl. ..... 16/333; 16/371

[58] Field of Search ..... 16/164, 145, 297, 333, 16/335, 371

[56] References Cited

U.S. PATENT DOCUMENTS

| | | | |
|---|---|---|---|
| 3,465,381 | 9/1969 | Lawrie et al. | 16/145 X |
| 3,991,437 | 11/1976 | Friederichs et al. | 16/333 |
| 4,050,116 | 9/1977 | Salice | 16/164 X |
| 4,226,001 | 10/1980 | Salice | 16/164 X |

FOREIGN PATENT DOCUMENTS

| | | | |
|---|---|---|---|
| 2303931 | 3/1976 | France | 16/164 |

*Primary Examiner*—Werner H. Schroeder
*Assistant Examiner*—Andrew M. Falik
*Attorney, Agent, or Firm*—Neil F. Markva

[57] ABSTRACT

A spring hinge assembly is used as a concealed furniture hinge. A frame hinge section and a leaf hinge section are connected by link members each having two pivot points and being movable between an open and a closed position. The hinge sections are under spring action with respect to one another with the leaf hinge section being held by a spring latch in the closed position. The extension of one of the link members includes a control cam which coacts with a lever element. The lever element carries a roller and is under spring action. A biasing mechanism is located on that side of the lever element remote from the link supporting plate of the frame hinge section. The biasing mechanism is effective to simultaneously engage the lever element and the link supporting plate and the biased lever element and the supporting plate outwardly from the frame member.

10 Claims, 5 Drawing Figures

CONCEALED MULTI PINTLE LATCH HINGE

FIELD OF INVENTION

This invention relates to a spring hinge assembly. More particularly, the spring hinge assembly is used as a furniture hinge arranged in a concealed position.

BACKGROUND OF THE INVENTION

The spring hinge assembly of this invention includes the frame hinge section and a leaf hinge section connected by link members each having two pivots. The frame hinge section comprises a base plate and a link supporting plate. The link supporting plate is longitudinally displaceable with respect to the base plate and may be adjusted and secured perpendicularly to the direction of displacement. The hinge sections face one another and are under spring action with respect to each other. The door leaf hinge section is held by a spring latch in the closed position of the hinge assembly.

Spring hinge assemblies of this type are well known and include a link member having an extension which projects into the frame hinge section and coacts with a lever member which is under spring action. The lever member is either hinged on the frame hinge section or with a pulley which is arranged on the lever member. In one constructional form of a spring hinge, helical compression springs are used as springs for the lever members. Generally there is little space available on the link supporting plate. Consequently, the helical compression springs have a comparatively small number of turns, thereby producing a hard springing action. With another known constructional form, the springs have long legs which extend over the full length of the link supporting plate. Consequently, when adjusting and fixing screws are arranged between the supporting plate and the base plate, the long leg spring includes a comparatively broad link supporting plate so that the legs of the spring are able to be arranged in the U formation of the supporting plate. As a whole the link supporting plate with a relatively large overall length and width is obtained. Nevertheless, the spring force of the spring is not very strong.

With another constructional form, a helical torsion spring is provided and the legs thereof are supported at one end on the pivotal part and on the other end on the fixed hinge component. The fitting of such a helical torsion spring is comparatively difficult. Furthermore, the helical torsion spring necessitates a comparatively large height of the frame hinge component and of the link supporting plate if the spring legs of the torsion spring are not to be overstressed. In all of the prior art constructions as set forth herein, the arrangement and fitting of the spring assembly for the lever in the link supporting plate is not satisfactory.

SUMMARY OF THE INVENTION

The primary object of the invention is to provide a spring hinge assembly of the type described above having a spring biasing means or biasing mechanism which requires a minimal space for fitting and has a high closing force and is extremely resilient.

The spring hinge assembly of this invention includes a leaf biasing means which is located on that side of the lever means remote from the link supporting plate. The biasing means is effective to simultaneously engage the lever means and the link supporting plate and to bias the lever means and supporting plate outwardly from the base plate of the frame hinge section.

Another feature of the invention is that the leaf biasing means is constructed as a double leaf spring with the free ends of the leaf sections being arranged facing the lever means. The leaf sections may be of different lengths and advantageously connected to one another at the end which engages the link supporting plate. With such a double leaf spring construction, the elastic effect is still further increased. Additionally, a higher spring force is obtained. It is possible to vary the spring values within comparatively wide limits and in a very simple manner.

Another feature of the invention is to secure the leaf spring on the link supporting plate using an opening or hole which engages over an eye-boss means of the link supporting plate. Such a boss means may at the same time accommodate the adjusting screw for the supporting plate. Consequently, the fitting of the spring system in the supporting plate is extremely compact.

A further feature of the invention is directed to the use of a U-shaped lever element having rollers or pulleys arranged externally on the lever cheek portions. The lever element configuration provides an immediate juxtaposition of the link members and the lever element within the width of the link supporting plate. A lug disposed on the transverse bar of the lever element may serve as the support of the leaf biasing means. At another location, the lever element or the roller disposed thereon may engage the angle shaped edge of the extension of the link member. In such an instance, the edge of the extension is formed as a projecting cam whereby the latching positions of the hinge sections in the closed position and in the open position are more effectively established. The extension is disposed on the link member of the linkage mechanism which engages the lower portion of the hinge cup.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1A:
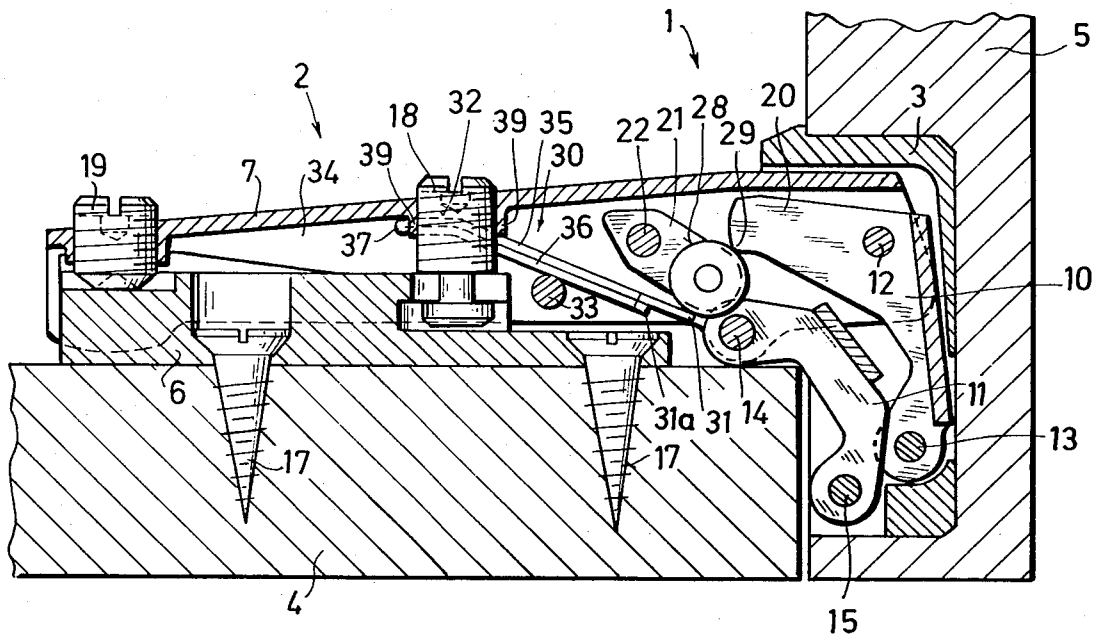
FIG. 1*a* is a diagrammatic, longitudinal sectional view showing a constructional example of the spring hinge according to the invention with a door leaf closed.

Spring hinge, generally designated 1, constitutes a concealed hinge for exposed door leaves. Hinge 1 comprises a frame hinge section 2 and a leaf hinge section 3 connected to frame 4 and door leaf 5, respectively. The leaf hinge section 3 has a known cup-like shape. The frame hinge section 2 includes a base plate 6 and a link-supporting plate 7. Plate 7 is connected to cup-shaped leaf hinge section 3 by a linkage mechanism including link members 10 and 11. Pivots 12 and 13 hinge link member 10 and pivots 14 and 15 hinge link member 11 on the hinge sections 2 and 3. The base plate 6 is fixed on frame 4 by screws 17. An adjusting screw 18 and a locking screw 19 are for the link-supporting plate 7.

Figure 4:
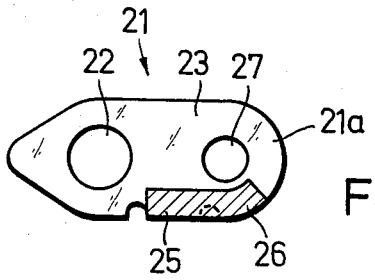
FIG. 4 is a longitudinal sectional view of a lever element according to the invention.
Figure 5:
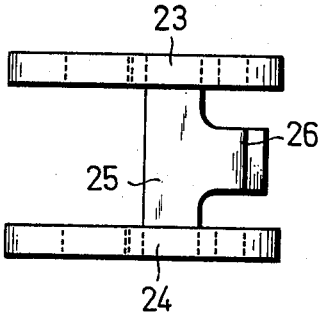
FIG. 5 is a plan view of the lever element of FIG. 4.

Link member 10 engages furthest into the leaf hinge cup 3 when the hinge section 2 and 3 are in the closed position and includes an extension 20 which engages with a lever element 21. See FIGS. 1 and 4. Lever element 21 is pivotable about the fixed pivot 22 and can engage at its free end 21*a* with the extension 20. Lever element 21 is U-shaped in cross section and includes cheek portions 23 and 24 and transverse arm 25 having a lug 26. In this specific embodiment, rollers 28 are mounted on pivot 27 and are located outside cheek portions 23 and 24. Extension 20 has an angular edge including a projecting cam 29 facing lever element 21. Cam 29 is used to secure the latching in the closed and open positions of the hinge. Extension 20 engages directly with the rounded ends 21*a* of lever element 21.

Lever element 21 is under the action of a leaf spring 30 disposed on that side of lever element 21 opposite from the supporting plate 7. Spring 30 bears on a transversely extending fixed stem 33 located between spring end 31 and end portion 32. Leaf spring 30 is supported with its free end 31 on lever element 21 and with its other end portion 32 on link-supporting plate 7. Stem 33 is advantageously formed as a pin and mounted in the leg 34 of the U-shaped link-supporting plate 7.

Figure 2:
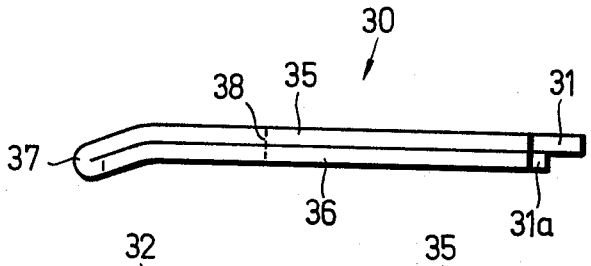
FIG. 2 is a side elevational view of a leaf spring according to the invention.
Figure 3:
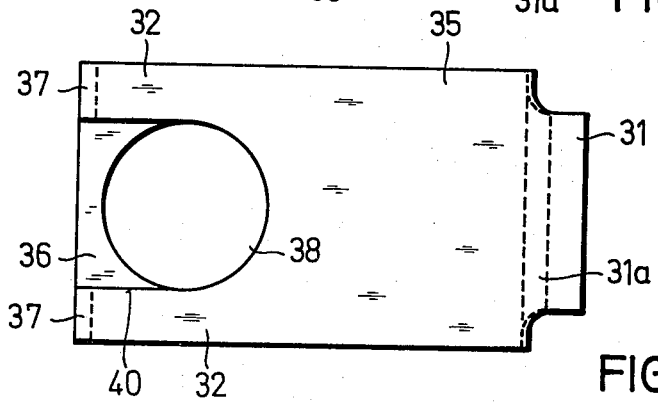
FIG. 3 is a plan view of the leaf spring shown in FIG. 2.

In this embodiment, leaf spring 30 is constructed as a double leaf spring and comprises leaf sections 35 and 36. The free ends 31 and 31*a* of double leaf spring 30 extend in a direction toward lever element 21. Leaf sections 35 and 36 are folded over by 180° with respect to one another to form interconnection 37 at the other end 32 of leaf spring 30. A hole 38 is located in the rearward portion of spring 30 and engages over an eye-boss 39. Thus, spring 30 is secured against longitudinal displacement. As shown in FIG. 2, the end portion 32 is at an angle to the normal path of leaf spring 30. Eye-boss 39 of plate 7 serves as a threaded sleeve for adjusting screw 18. A recess 40 is formed adjacent bore 38 in leaf section 36 as far as the rearward end of end portion 32.

Figure 1B:
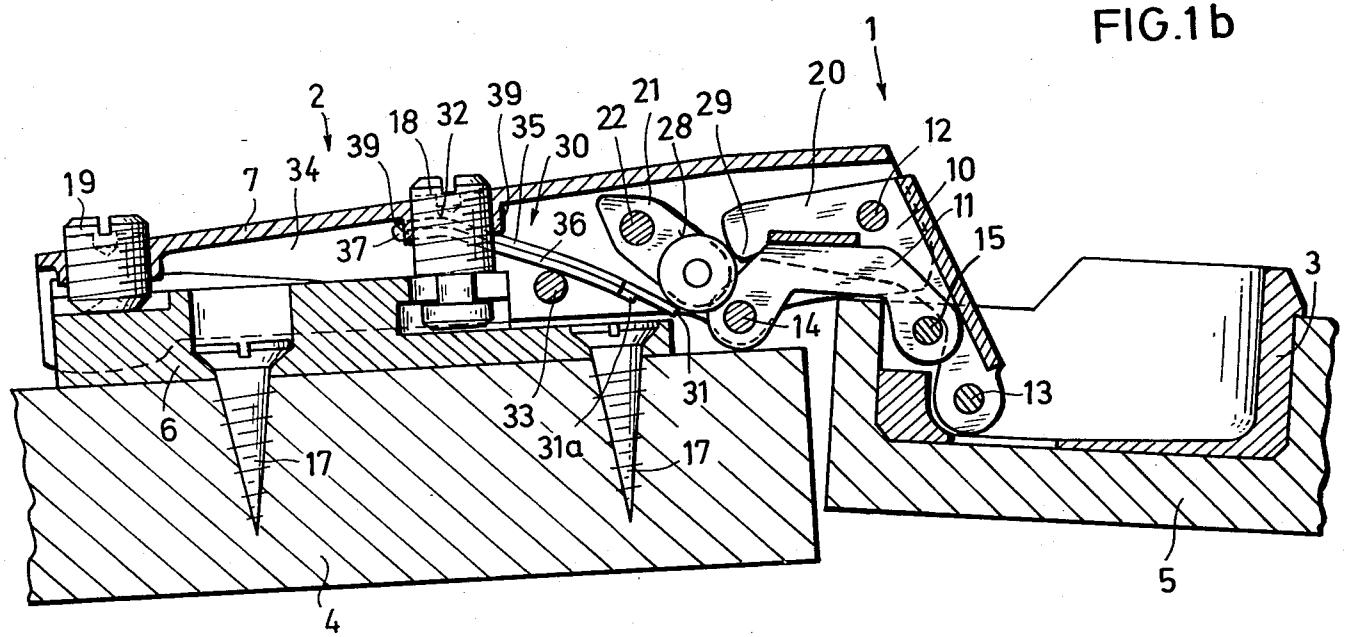
FIG. 1*b* is the spring-hinge of FIG. 1*a* shown with the door leaf open.

FIG. 1 shows the position of the parts under the action of the leaf spring 30 when door leaf 5 is closed with leaf hinge section 3. In the opened position of door leaf 5, the free end 21*a* of lever 21 engages with the end face of extension 20 of link member 10. In this instance, the cam 29 of extension 20 forms a peak pressure point.

ADVANTAGES OF THE INVENTION

A leaf biasing means provided in the manner according to this invention makes it possible to provide an arrangement and fitting which is extremely economical with respect to space requirements. The overall height of the link supporting plate may be held comparatively small. The fitting is to be carried out easily and quickly. The leaf spring biasing means is independent of tolerance and provides a strong closing force and is durable. In addition, the leaf biasing means provides a high elasticity.

While the spring hinge assembly has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A spring hinge assembly for use as a concealed furniture hinge, said assembly comprising:

(a) a frame hinge section and a leaf hinge section connected by link members each having two pivot points and being movable between an open and a closed position, (b) the frame hinge section comprises a base plate and a link supporting plate, (c) said hinge sections being under spring action with respect to one another with the leaf hinge section being held by a spring latch in said closed position, (d) one link member having an extension on its end projecting into the frame hinge section, (e) the extension including a control cam which coacts with a lever means, (f) said lever means including a roller disposed on a lever element which is under spring action and is linked to the frame hinge section, (g) biasing means is located on that side of the lever means remote from the link supporting plate, (h) said biasing means being effective to simultaneously engage the lever means and the link supporting plate and to bias the lever means and supporting plate outwardly from the base plate, (i) the link supporting plate includes an eye-boss means which extends toward the base plate and receives an adjusting screw for the link supporting plate, (j) said biasing means includes a leaf spring having an opening to surround said eye-boss means.

2. An assembly as defined in claim 1 wherein said biasing means includes a leaf spring having one end engaging said lever means and the other end engaging the link supporting plate.

3. An assembly as defined in claim 2 wherein said leaf spring bears on a fixed support means between the ends which engage said lever means and supporting plate.

4. An assembly as defined in claim 3 wherein said fixed support means comprises a pin fixed to the link supporting plate and extending in a direction to bear against the leaf spring.

5. An assembly as defined in claim 1 wherein said biasing means comprises a double leaf spring having two leaf parts having different lengths with a different location for each of the two free ends of the leaf spring facing the lever means.

6. The assembly as defined in claim 1 wherein said biasing means comprises a double leaf spring formed as a single piece and folded over to form two leaf sections connected by a folded end section which engages said link supporting plate.

7. A spring hinge assembly for use as a concealed furniture hinge, said assembly comprising:

(a) a frame hinge section and a leaf hinge section connected by link members each having two pivot points and being movable between an open and a closed position, (b) the frame hinge section comprises a base plate and a link supporting plate, (c) said hinge sections being under spring action with respect to one another with the leaf hinge section being held by a spring latch in said closed position, (d) one link member having an extension on its end projecting into the frame hinge section, (e) the extension including a control cam which coacts with a lever means, (f) said lever means including a roller disposed on a lever element which is under spring action and is linked to the frame hinge section, (g) biasing means is located on that side of the lever means remote from the link supporting plate, (h) said biasing means being effective to simultaneously engage the lever means and the link supporting plate and to bias the lever means and supporting plate outwardly from the base plate, (i) said biasing means comprises a double leaf spring formed as a single piece and folded over to form two leaf sections connected by a folded end section which engages said link supporting plate, and (j) said leaf spring has the two leaf parts having different lengths with a different location for each of the two free ends of the leaf spring facing the lever means.

8. An assembly as defined in either claim 1 or 7 wherein the lever element has a U-shaped cross section with two upstanding cheek portions which carry roller members on the outside thereof, a lug means is disposed on a transverse arm of the lever element between the cheek portions.

9. The assembly as defined in either claim 1 or 7 wherein the link member extension includes an angular edge forming said control cam which engages either said lever element or the rollers.

10. The assembly as defined in either claim 1 or 7 wherein the supporting plate is longitudinally displaceable with respect to the base plate and is adjustable and secured perpendicularly of the plane of displacement.

* * * * *